US011417289B2

(12) United States Patent
Wu

(10) Patent No.: US 11,417,289 B2
(45) Date of Patent: Aug. 16, 2022

(54) DRIVING CIRCUIT OF DISPLAY PANEL AND OPERATION METHOD THEREOF

(71) Applicant: HIMAX TECHNOLOGIES LIMITED, Tainan (TW)

(72) Inventor: Tung-Ying Wu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/136,058

(22) Filed: Dec. 29, 2020

(65) Prior Publication Data

US 2022/0208135 A1 Jun. 30, 2022

(51) Int. Cl.

| | |
|---|---|
| ***G09G 3/36*** | (2006.01) |
| ***G09G 3/20*** | (2006.01) |
| ***G09G 3/34*** | (2006.01) |

(52) U.S. Cl.

CPC ..... *G09G 3/3607* (2013.01); *G09G 3/2007* (2013.01); *G09G 3/2096* (2013.01); *G09G 3/3406* (2013.01); *G09G 3/3648* (2013.01); *G09G 2300/023* (2013.01); *G09G 2310/0232* (2013.01); *G09G 2320/028* (2013.01); *G09G 2320/0626* (2013.01); *G09G 2360/16* (2013.01)

(58) Field of Classification Search

CPC ..... G09G 3/3607; G09G 3/3406; G09G 2300/023; G09G 2310/0232; G09G 2320/028; G09G 2320/0626; G09G 2360/16

See application file for complete search history.

(56) References Cited

U.S. PATENT DOCUMENTS

| | | | | |
|---|---|---|---|---|
| 2008/0088649 | A1* | 4/2008 | Ikeno | G09G 3/3611 345/204 |
| 2018/0059465 | A1* | 3/2018 | Koudo | G02F 1/13471 |
| 2019/0259342 | A1* | 8/2019 | Tada | G09G 3/36 |

* cited by examiner

*Primary Examiner* — David Tung

(74) *Attorney, Agent, or Firm* — JCIPRNET

(57) ABSTRACT

The invention provides a driving circuit of a display panel and an operation method thereof. The driving circuit includes a calculation circuit and an edge processing circuit. The calculation circuit converts original image frame data into first image frame data for driving a first pixel array layer and second image frame data for driving a second pixel array layer. The edge processing circuit converts the second image frame data into third image frame data. The edge processing circuit performs an edge detection on a current pixel in the second image frame data to determine whether the current pixel belongs to an image edge. The edge processing circuit determines whether to adjust a gray level of an adjacent pixel in the second image frame data as the gray level of the adjacent pixel in the third image frame data according to a result of the edge detection.

20 Claims, 5 Drawing Sheets

| | | |
|---|---|---|
| W(x−1,y−1) | W(x,y−1) | W(x+1,y−1) |
| W(x−1,y) | W(x,y) | W(x+1,y) |
| W(x−1,y+1) | W(x,y+1) | W(x+1,y+1) |

DRIVING CIRCUIT OF DISPLAY PANEL AND OPERATION METHOD THEREOF

TECHNICAL FIELD

The invention relates a display device, and more particularly, relates to a driving circuit of a display panel and an operation method thereof.

BACKGROUND

Liquid-Crystal Display (LCD) is a flat and thin display device. A pixel array of the LCD consists of a certain number of color or black and white pixels. Because the liquid crystal does not emit light, a light source needs to be placed on the back of the liquid crystal display. In order to achieve high dynamic range (HDR), a local dimming technology is applied to liquid crystal display devices. The local dimming is to achieve HDR by adjusting the brightness of a backlight source. A direct-lit backlight source can realize the local dimming. The direct-lit backlight source may be defined as a backlight array having a plurality of light-emitting areas, and each light-emitting area has one or more light-emitting elements (e.g., light-emitting diodes). Based on screen characteristics of the LCD, the light-emitting areas can be dimmed independently. The higher the resolution of the backlight array, the better the HDR effect. However, a thickness of the directs-lit backlight source is thicker than a thickness of a side-emitting backlight source. Furthermore, the higher the resolution of the backlight array (the smaller and more light-emitting diodes), the higher the cost of the direct-lit backlight.

It should be noted that, the content in the paragraph "Description of Related Art" are intended to assist understanding the invention. Part of the content (or all content) disclosed in the paragraph "Description of Related Art" may not be the conventional technology known by a person of ordinary skill in the art. The content disclosed in the paragraph "Description of Related Art" may not mean the content is known by a person of ordinary skill in the art before application of the invention.

SUMMARY

The invention provides a driving circuit and an operation method thereof to realize the local dimming.

In an embodiment of the invention, the driving circuit is suitable for driving a display panel. The driving circuit includes a calculation circuit and an edge processing circuit. The calculation circuit is configured to convert original image frame data into first image frame data and second image frame data. The first image frame data is suitable for driving the first pixel array layer of the display panel. The second image frame data is suitable for driving a second pixel array layer of the display panel, and the first pixel array layer is stacked on the second pixel array layer. The edge processing circuit is coupled to the calculation circuit to receive the second image frame data. The edge processing circuit is configured to convert the second image frame data into third image frame data. The third image frame data is suitable for driving the second pixel array layer. The edge processing circuit performs an edge detection on a current pixel in the second image frame data to determine whether the current pixel belongs to an image edge. The edge processing circuit determines whether to adjust a gray level of at least one adjacent pixel in the second image frame data as the gray level of the at least one adjacent pixel in the third image frame data according to a result of the edge detection.

In an embodiment of the invention, the operation method includes: converting original image frame data into first image frame data and second image frame data by a calculation circuit, wherein the first image frame data is suitable for driving a first pixel array layer of a display panel, the second image frame data is suitable for driving a second pixel array layer of the display panel, and the first pixel array layer is stacked on the second pixel array layer; and converting the second image frame data into third image frame data by an edge processing circuit, wherein the third image frame data is suitable for driving the second pixel array layer, the edge processing circuit performs an edge detection on a current pixel in the second image frame data to determine whether the current pixel belongs to an image edge, and the edge processing circuit determines whether to adjust a gray level of at least one adjacent pixel in the second image frame data as the gray level of the at least one adjacent pixel in the third image frame data according to a result of the edge detection.

Based on the above, the driving circuit and the operation method described in various embodiments of the invention can drive a plurality of pixel array layers of the display panel. At least one pixel array layer of these pixel array layers can realize the local dimming function. In some application scenarios, a display panel with multiple pixel array layers may have the dual cell local dimming side view object invisible issue. The driving circuit can perform the edge detection on the current pixel to determine whether the current pixel belongs to the image edge. According to the result of the edge detection, the driving circuit can determine whether to adjust the gray level of the at least one adjacent pixel of the current pixel. For example, when the current pixel belongs to a bright image edge and the gray level of the adjacent pixel is black, the driving circuit can appropriately brighten the gray levels of that adjacent pixel. In this way, the driving circuit can solve the dual cell local dimming side view object invisible issue to improve the clarity of cell local dimming side view object.

To make the aforementioned more comprehensible, several embodiments accompanied with drawings are described in detail as follows.

DESCRIPTION OF THE EMBODIMENTS

Figure 1:
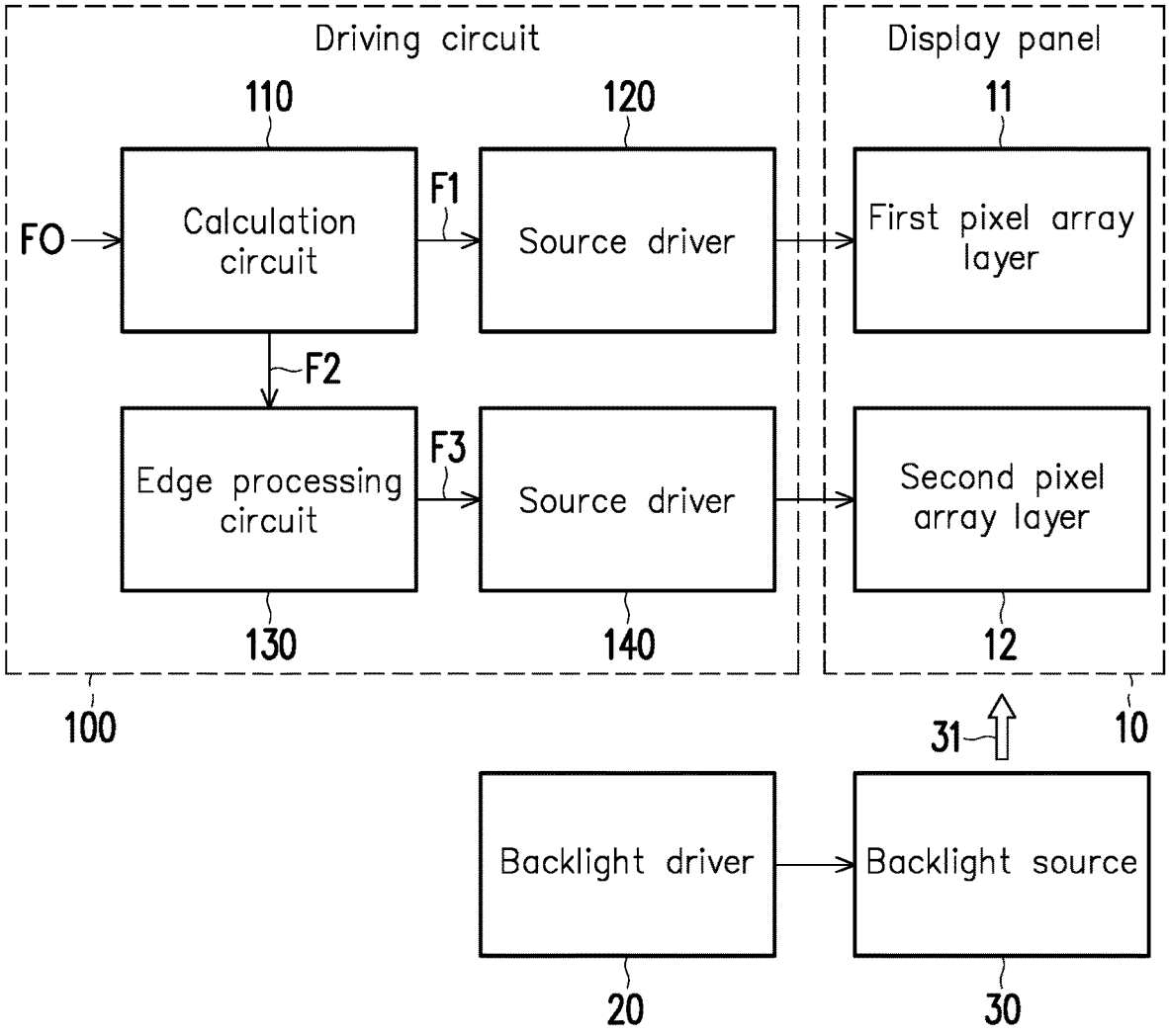
FIG. 1 is a circuit block diagram of a display device according to an embodiment of the invention.

The term "coupled (or connected)" used in this specification (including claims) may refer to any direct or indirect connection means. For example, "a first device is coupled (connected) to a second device" should be interpreted as "the first device is directly connected to the second device" or "the first device is indirectly connected to the second device through other devices or connection means". The terms such as "first", "second" and the like as recited in full text of the specification (including claims) are intended to give the elements names or distinguish different embodiments or scopes, and are not intended to limit an upper limit or a lower limit of the number of the elements nor limit an order of the elements. Moreover, wherever possible, elements/components/steps with same reference numerals represent same or similar parts in the drawings and embodiments. Elements/components/steps with the same reference numerals or names in different embodiments may be cross-referenced.

FIG. 1 is a circuit block diagram of a display device according to an embodiment of the invention. A display device shown in FIG. 1 includes a driving circuit 100, a display panel 10, a backlight driver 20 and a backlight source 30. Based on the driving of the backlight driver 20, the backlight source 30 can provide a backlight 31 to the display panel 10. According to design requirements, the backlight source 30 may be a direct-lit backlight source, a side-emitting backlight source, or other backlight sources. In some embodiments, the backlight source 30 may not have a dimming function. In some other embodiments, the backlight source 30 may have a local dimming function. In some other embodiments, the backlight source 30 may have a global dimming function.

According to design requirements, the display panel 10 may include a liquid crystal display (LCD) panel or other non-self-luminous display panels. The display panel 10 has a plurality of pixel array layers, and at least one pixel array layer of the pixel array layers can realize the local dimming function and (or) the global dimming function. For instance, the display panel 10 shown in FIG. 1 includes a first pixel array layer 11 and a second pixel array layer 12. The first pixel array layer 11 is stacked on the second pixel array layer 12, and the second pixel array layer 12 can realize the local dimming function and (or) the global dimming function. According to design requirements, the first pixel array layer 11 may include a color pixel array or other pixel arrays, and second pixel array layer 12 may include a gray pixel array or other pixel arrays. According to design requirements, in some embodiments, the first pixel array layer 11 and second pixel array layer 12 may be two LCD pixel arrays or other non-self-luminous pixel arrays.

According design requirements, a diffuser (not shown) may be disposed between the first pixel array layer 11 and the second pixel array layer 12. In the case that the second pixel array layer 12 is transparent, the backlight 31 provided by the backlight source 30 can be irradiated to the first pixel array layer 11 through the second pixel array layer 12. The driving circuit 100 can control a gray level (luminous flux) of each pixel of the second pixel array layer 12. Based on the driving and control of the driving circuit 100, the second pixel array layer 12 can adjust the amount of light irradiated to the first pixel array layer 11, thereby realizing the local dimming function and (or) the global dimming function. Based on the driving and control of the driving circuit 100, the first pixel array layer 11 can display color images (or monochrome images).

Figure 2:
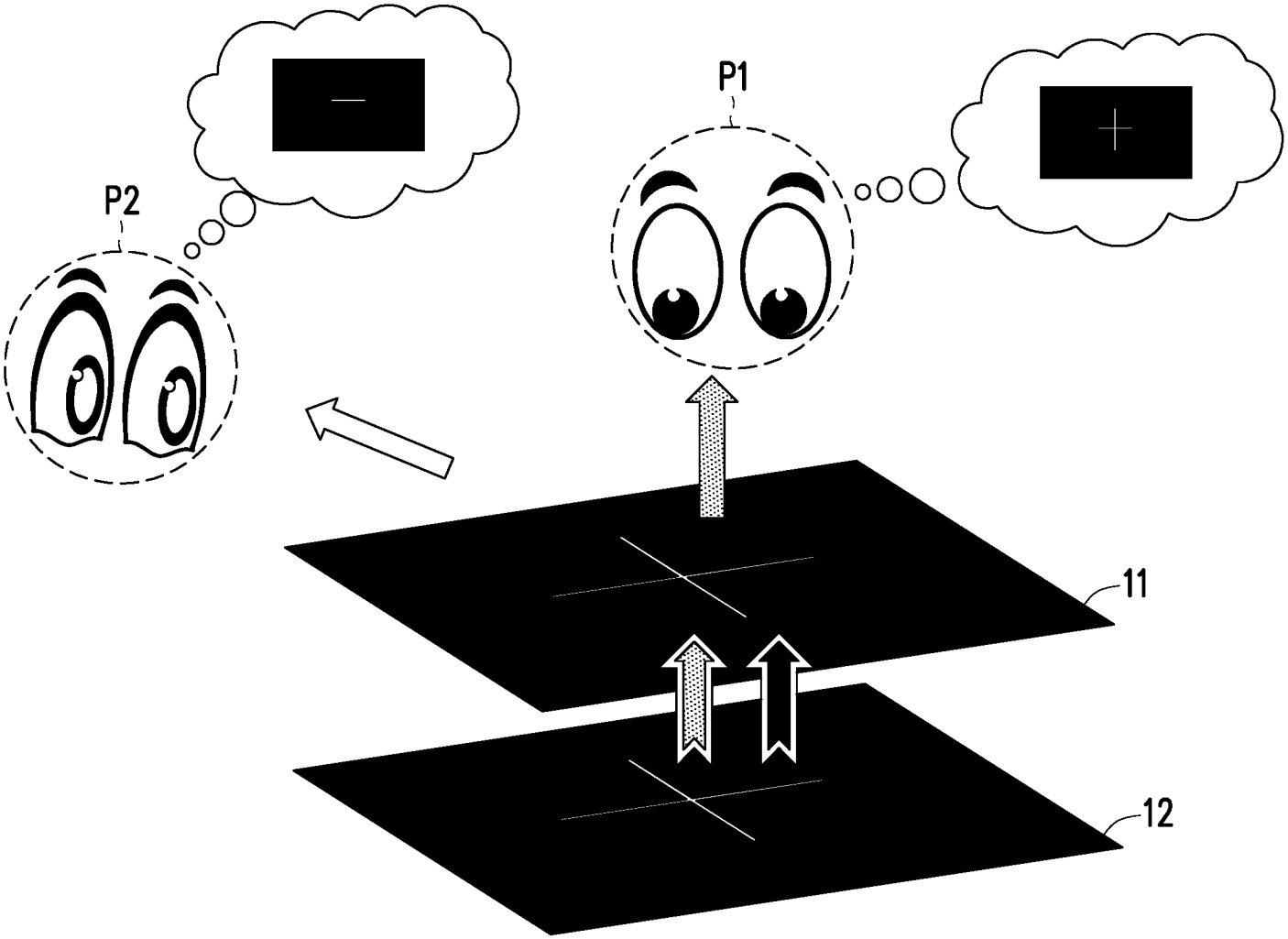
FIG. 2 is a schematic scenario diagram illustrating the dual cell local dimming side view object invisible issue.

However, in some application scenarios, a display panel with multiple pixel array layers may have the dual cell local dimming side view object invisible issue. FIG. 2 is a schematic scenario diagram illustrating the dual cell local dimming side view object invisible issue. Referring to FIG. 1 and FIG. 2, in some application scenarios, the driving circuit 100 can convert original image frame data FO into first image frame data F1 and second image frame data F2. The first image frame data F1 is suitable for driving the first pixel array layer 11 of the display panel 10, and the second image frame data F2 is suitable for driving the second pixel array layer 12 of the display panel 10. Here, it is assumed that the original image frame data FO is used as the first image frame data F1, and the second image frame data F2 is used as third image frame data F3 shown in FIG. 1.

Based on the driving and control of the driving circuit 100, the first pixel array layer 11 displays a white "+" image (the background is black), and the second pixel array layer 12 also displays a white "+" image at the corresponding position (the background is black, that is, the local dimming is performed). Therefore, the user can view the white "+" image with a high dynamic range (HDR) effect at a position P1 directly in front of the display panel 10. However, for a position P2 obliquely in front of the display panel 10, no light passes through a vertical line portion of the white "+" image displayed by the first pixel array layer 11 and irradiates the position P2. Therefore, when the user views the display panel 10 at the position P2 obliquely in front of the display panel 10, the user can only see a horizontal line portion of the white "+" image but not the vertical line portion of the white "+" image.

The phenomenon shown in FIG. 2 is so-called "the dual cell local dimming side view object invisible issue". Multiple embodiments will be used below to illustrate how to solve the dual cell local dimming side view object invisible issue as much as possible so as to improve the clarity of cell local dimming side view object.

In the embodiment shown in FIG. 1, the driving circuit 100 includes a calculation circuit 110, a source driver 120, an edge processing circuit 130 and a source driver 140. According to design requirements, the calculation circuit 110, the source driver 120, the edge processing circuit 130 and the source driver 140 may be integrated into one single integrated circuit or implemented as different integrated circuits. For instance, in some embodiments, the calculation circuit 110 and the edge processing circuit 130 may be integrated into a timing controller; the source driver 120 may be implemented as another integrated circuit; and the source driver 140 may be implemented as yet another integrated circuit. In other embodiments, the source driver 120 and the source driver 140 may removed from the driving circuit 100.

Figure 3:
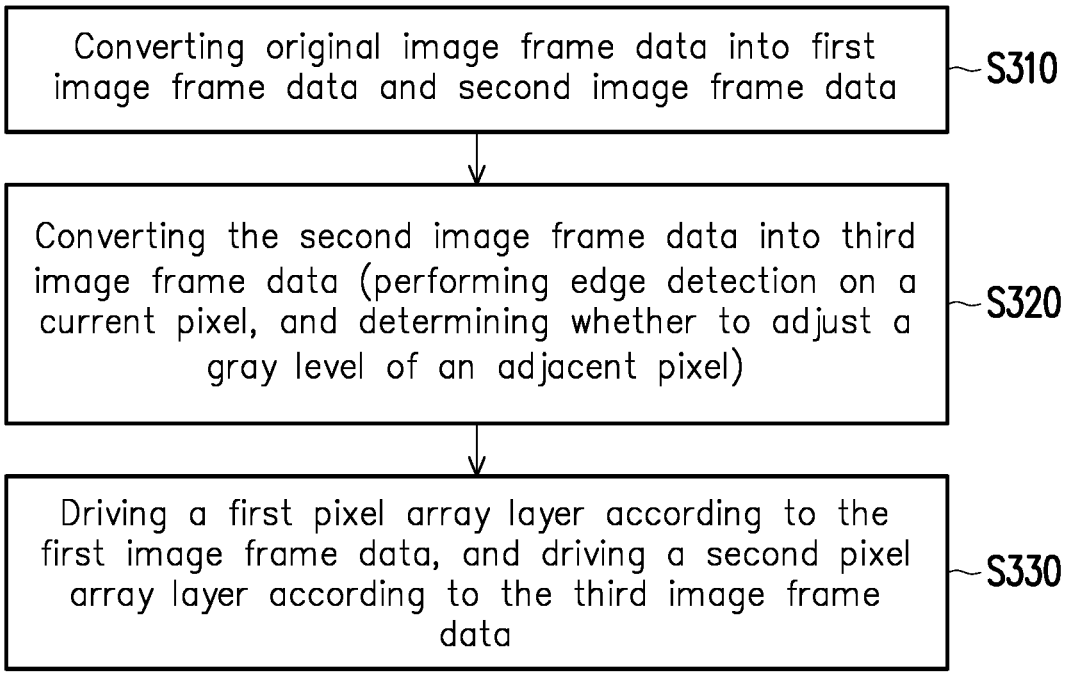
FIG. 3 is a flowchart of an operating method of a driving circuit according to an embodiment of the invention.

FIG. 3 is a flowchart of an operating method of a driving circuit according to an embodiment of the invention. Referring to FIG. 1 and FIG. 3, the original image frame data FO is a pixel data streaming. In step S310, the calculation circuit 110 can convert the original image frame data FO into the first image frame data F1 and the second image frame data F2. The first image frame data F1 is suitable for driving the first pixel array layer 11 of the display panel 10, and the second image frame data F2 is suitable for driving the second pixel array layer 12 of the display panel 10.

Based on actual design, the resolution of the second image frame data F2 can be different from (or the same as) the resolution of the original image frame data FO, and the resolution of the second image frame data F2 can be different from (or the same as) the resolution of the first image frame data F1. For example, in some embodiments, the resolution of the second image frame data F2 may be smaller than the resolution of the original image frame data FO. This embodiment does not limit the implementation of converting the original image frame data FO into the second image frame data F2. For example, in some embodiments, the calculation circuit 110 may convert data of four pixels (or other numbers of pixels) in the original image frame data FO into data of one pixel of the second image frame data F2. For example, the calculation circuit 110 may calculate an average of the data of four pixels in the original image frame data FO, and use the average as the data of one pixel in the second image frame data F2.

This embodiment does not limit the conversion algorithm of the calculation circuit 110. According to design requirements, in some embodiments, the calculation circuit 110 can output the original image frame data FO as the first image frame data F1 to the source driver 120, and The calculation circuit 110 can execute a conventional local dimming algorithm (or other dimming algorithms) to convert the original image frame data FO into dimming data (the second image frame data F2). In some other embodiments, the calculation circuit 110 can generate the first image frame data F1 by compensating the original image frame data FO according to the dimming data.

Figure 4:
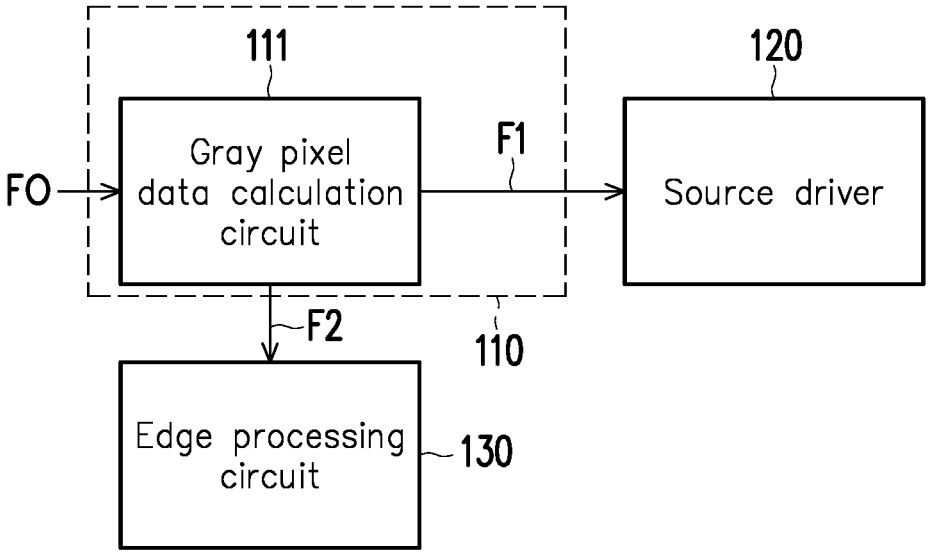
FIG. 4 is a circuit block diagram of a calculation circuit shown in FIG. 1 according to an embodiment of the invention.

FIG. 4 is a circuit block diagram of the calculation circuit 110 shown in FIG. 1 according to an embodiment of the invention. The calculation circuit 110 shown in FIG. 4 includes a gray pixel data calculation circuit 111. The gray pixel data calculation circuit 111 can output the original image frame data FO as the first image frame data F1 to the source driver 120. The gray pixel data calculation circuit 111 can calculate a gray level of a current pixel in the second image frame data F2 according to at least one pixel data of at least one corresponding pixel in the original image frame data FO. A position of the corresponding pixel in the original image frame data FO corresponds to a position of the current pixel in the second image frame data F2. This embodiment does not limit the conversion algorithm of the gray pixel data calculation circuit 111. According to design requirements, in some embodiments, the gray pixel data calculation circuit 111 can execute a conventional local dimming algorithm (or other dimming algorithms) to convert the original image frame data FO into dimming data (the second image frame data F2). The gray pixel data calculation circuit 111 can output the second image frame data F2 to the edge processing circuit 130.

Figure 5:
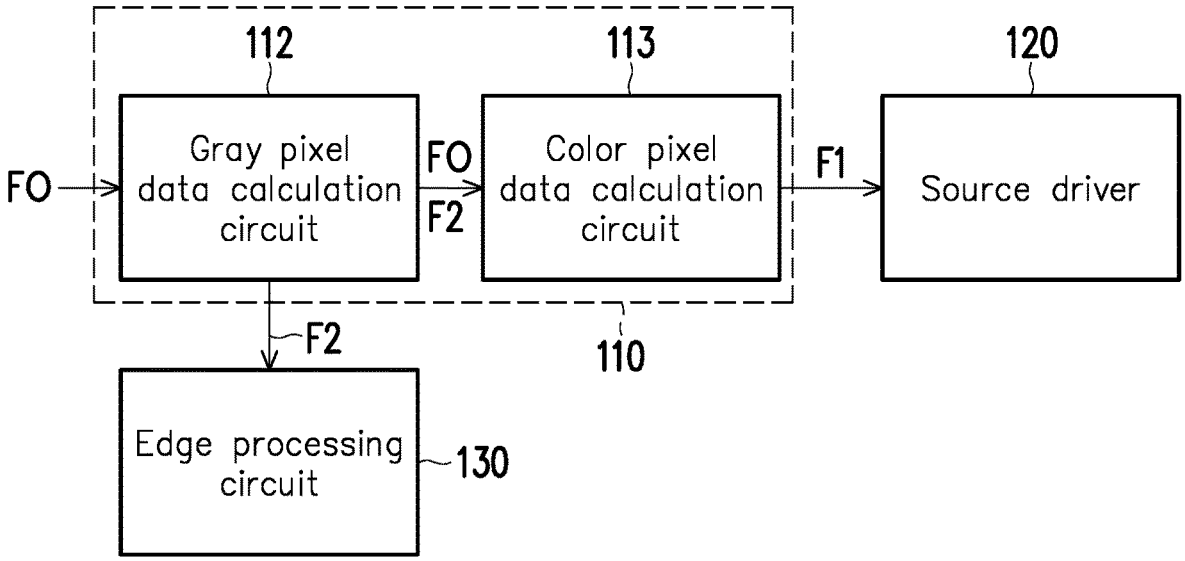
FIG. 5 is a circuit block diagram of a calculation circuit shown in FIG. 1 according to another embodiment of the invention.

FIG. 5 is a circuit block diagram of the calculation circuit 110 shown in FIG. 1 according to another embodiment of the invention. The calculation circuit 110 shown in FIG. 5 includes a gray pixel data calculation circuit 112 and a color pixel data calculation circuit 113. The gray pixel data calculation circuit 112 can output the original image frame data FO to the color pixel data calculation circuit 113. The gray pixel data calculation circuit 112 can calculate a gray level of a current pixel in the second image frame data F2 according to at least one pixel data of at least one corresponding pixel in the original image frame data FO. The gray pixel data calculation circuit 112 shown in FIG. 5 can be deduced by referring to the related description of the gray pixel data calculation circuit 111 shown in FIG. 4, which is not repeated hereinafter. The gray pixel data calculation circuit 112 shown in FIG. 5 can output the second image frame data F2 to the edge processing circuit 130 and the color pixel data calculation circuit 113.

The color pixel data calculation circuit 113 is coupled to the gray pixel data calculation circuit 112 to receive the original image frame data FO and the second image frame data F2. The color pixel data calculation circuit 113 can generate the first image frame data F1 for the source driver 120 by compensating the pixel data of the corresponding pixel in the original image frame data FO according to the gray level of the current pixel in the second image frame data F2. This embodiment does not limit the conversion algorithm of the color pixel data calculation circuit 113. According to design requirements, in some embodiments, the color pixel data calculation circuit 113 can execute a conventional local dimming algorithm (or other dimming algorithms) to compensate the pixel data in the original image frame data FO.

Referring to FIG. 1 and FIG. 3, the edge processing circuit 130 is coupled to the calculation circuit 110 to receive the second image frame data F2. In step S320, the edge processing circuit 130 can convert the second image frame data F2 into the third image frame data F3. The third image frame data F3 is suitable for driving the second pixel array layer 12 of the display panel 10. In the conversion operation of step S320, the edge processing circuit 130 can performs an edge detection on the current pixel in the second image frame data F2 to determine whether the current pixel belongs to an image edge. According to a result of the edge detection, the edge processing circuit 130 can determine whether to adjust a gray level of at least one adjacent pixel in the second image frame data F2 as the gray level of the at least one adjacent pixel in the third image frame data F3. The adjacent pixel is located near the current pixel. For instance, in some embodiments, the adjacent pixel is adjacent to the current pixel. In some other embodiments, the adjacent pixel include multiple pixels within a range of n pixels from the current pixel, where n is a positive integer determined according to design requirements.

Figure 6:
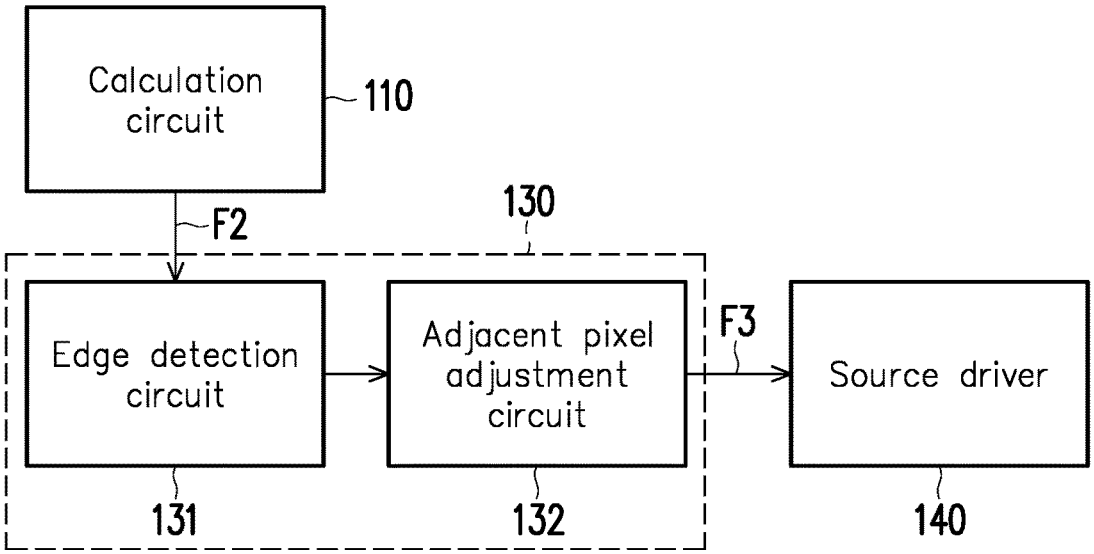
FIG. 6 is a circuit block diagram of an edge processing circuit shown in FIG. 1 according to an embodiment of the invention.

FIG. 6 is a circuit block diagram of the edge processing circuit 130 shown in FIG. 1 according to an embodiment of the invention. The edge processing circuit 130 shown in FIG. 6 includes an edge detection circuit 131 and an adjacent pixel adjustment circuit 132. The edge detection circuit 131 is coupled to the calculation circuit 110 to receive the second image frame data F2. The edge detection circuit 131 can determine whether the current pixel belongs to the image edge by checking a relation between the gray level of the current pixel and the gray level of the adjacent pixel in the second image frame data F2, and output the result of the edge detection to the adjacent pixel adjustment circuit 132.

Figures 7, 8:
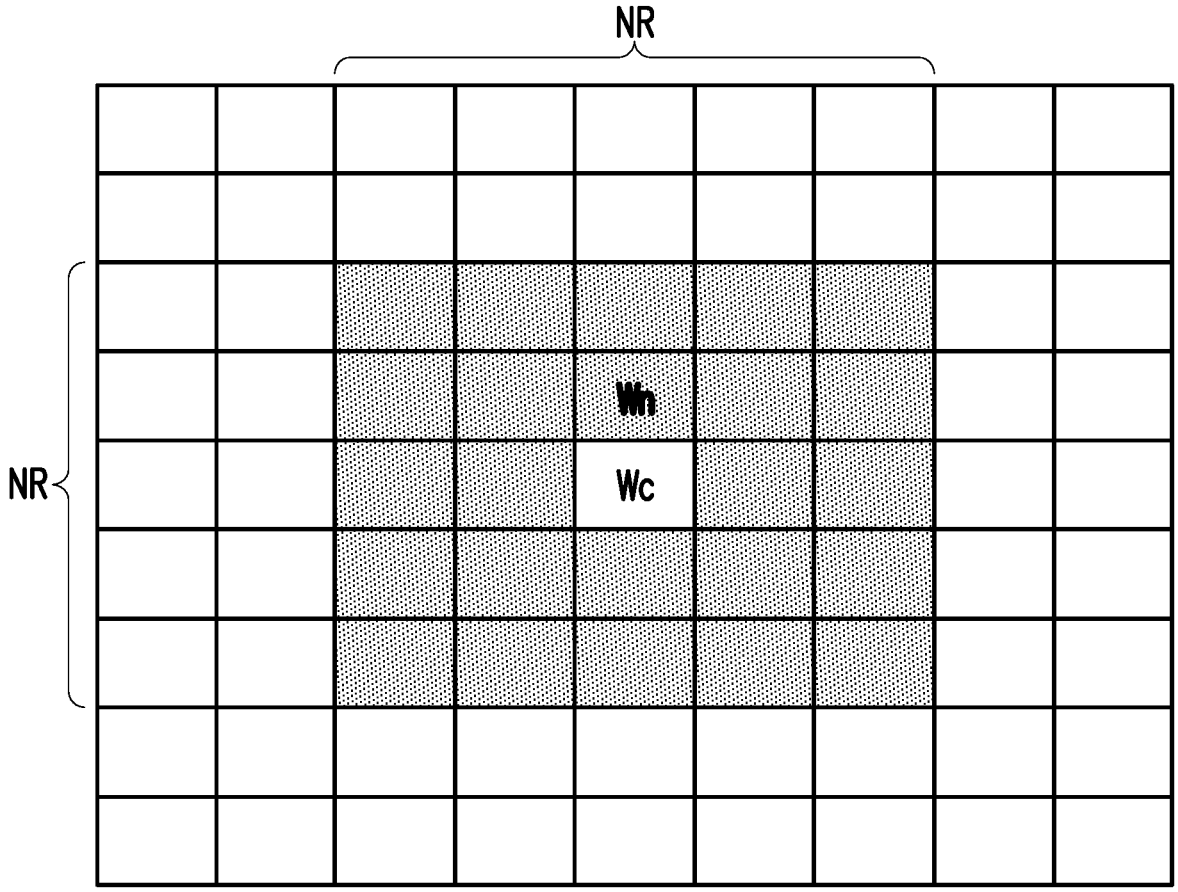
FIG. 7 is a schematic diagram illustrating a current pixel and adjacent pixels according to an embodiment of the invention.
FIG. 8 is a schematic diagram illustrating a current pixel and adjacent pixels according to another embodiment of the invention.

FIG. 7 is a schematic diagram illustrating a current pixel and adjacent pixels according to an embodiment of the invention. The adjacent pixel may be multiple pixels within a range of n pixels from the current pixel. In the embodiment shown in FIG. 7, multiple pixels W(x−1, y−1), W(x, y−1), W(x+1, y−1), W(x−1, y), W(x, y), W(x+1, y), W(x−1, y+1), W(x, y+1) and W(x+1, y+1) within a range of one pixel from the current pixel W(x, y) can be defined as the adjacent pixels. The edge detection circuit 131 can check a relation between a gray level of the current pixel W(x, y) and gray levels of the adjacent pixels. For instance, the edge detection circuit 131 can obtain a plurality of gray level differences by calculating a difference between the gray level of the current pixel W(x, y) and a gray level of each of the adjacent pixels shown in FIG. 7. That is to say, the edge detection circuit 131 can calculate Equation 1 to Equation 8 below to obtain the grayscale differences EdUL_W, EdU_W, EdUR_W, EdL_W, EdR_W, EdDL_W, EdD_W and EdDR_W.

$$EdUL_W=|W(x,y)-W(x-1,y-1)| \quad \text{Equation 1}$$

$$EdU_W=|W(x,y)-W(x,y-1)| \quad \text{Equation 2}$$

$$EdUR_W=|W(x,y)-W(x+1,y-1)| \quad \text{Equation 3}$$

$$EdL_W=|W(x,y)-W(x-1,y)| \quad \text{Equation 4}$$

$$EdR_W=|W(x,y)-W(x+1,y)| \quad \text{Equation 5}$$

$$EdDL_W=|W(x,y)-W(x-1,y+1)| \quad \text{Equation 6}$$

$$EdD_W=|W(x,y)-W(x,y+1)| \quad \text{Equation 7}$$

$$EdDR_W=|W(x,y)-W(x+1,y+1)| \quad \text{Equation 8}$$

The edge detection circuit 131 can determine whether the current pixel W(x, y) belongs to the image edge by checking the gray level differences shown by Equation 1 to Equation 8. For example (but not limited thereto), the edge detection circuit 131 may take a largest difference of these gray level differences EdUL_W, EdU_W, EdUR_W, EdL_W, EdR_W, EdDL_W, EdD_W and EdDR_W as a representative difference ED_W(x, y) corresponding to the current pixel W(x, y). In some other embodiments, the edge detection circuit 131 may take an average value (or other value) of these gray level differences EdUL_W, EdU_W, EdUR_W, EdL_W, EdR_W, EdDL_W, EdD_W and EdDR_W as the representative difference ED_W(x, y). The edge detection circuit 131 can determine whether the current pixel W(x, y) belongs to the image edge by comparing the representative difference ED_W(x, y) with a threshold ED_th. Here, the threshold ED_th may be any real number determined according to design requirements. For instance, when the representative difference ED_W(x, y) is greater than or equal to the threshold ED_th, the edge detection circuit 131 can determine that the current pixel W(x, y) belongs to the image edge. Conversely, when the representative difference ED_W (x, y) is less than the threshold ED_th, the edge detection circuit 131 can determine that the current pixel W(x, y) does not belong to the image edge.

Referring to FIG. 6, the adjacent pixel adjustment circuit 132 is coupled to the edge detection circuit 131 to receive the result of the edge detection. The adjacent pixel adjustment circuit 132 can determine whether to adjust a gray level of an adjacent pixel in the second image frame data F2 as the gray level of the adjacent pixel in the third image frame data F3 according to a result of the edge detection. For instance, when the result of the edge detection of the edge detection circuit 131 indicates that the current pixel W(x, y) does not belong to the image edge, the adjacent pixel adjustment circuit 132 can use the gray level of the adjacent pixel in the second image frame data F2 as the gray level of the adjacent pixel in the third image frame data F3 (i.e., the gray level of the adjacent pixel is not adjusted). When the result of the edge detection of the edge detection circuit 131 indicates that the current pixel W(x, y) belongs to the image edge, the adjacent pixel adjustment circuit 132 can determine whether to adjust the gray level of the adjacent pixel in the second image frame data F2 as the gray level of the adjacent pixel in the third image frame data F3 by checking the gray level of the adjacent pixel.

FIG. 8 is a schematic diagram illustrating a current pixel and adjacent pixels according to another embodiment of the invention. In the embodiment shown in FIG. 8, 24 pixels (e.g., the pixel Wn shown in FIG. 8) within a range NR of two pixels from a current pixel Wc may be defined as the adjacent pixels. The pixel Wn shown in FIG. 8 is referred to herein as a target adjacent pixel, and other adjacent pixels within the range NR can be deduced by referring to the related description of the adjacent pixel Wn. The adjacent pixel adjustment circuit 132 can compare a gray level of the target adjacent pixel Wn with a threshold gray level Nbrlevel_Th. Here, the threshold gray level Nbrlevel_Th may be any real number determined according to design requirements. When the result of the edge detection of the edge detection circuit 131 indicates that the current pixel Wc belongs to the image edge and the gray level of the target adjacent pixel Wn is less than the threshold gray level Nbrlevel_Th, the adjacent pixel adjustment circuit 132 can adjust the gray level of the target adjacent pixel Wn to a register define gray level. The register define gray level may be recorded in a parameter register. A system and (or) a user can set and update the register define gray level recorded in the parameter register through an access interface.

For instance, the edge detection circuit 131 can determine whether the current pixel Wc belongs to the image edge. When the result of the edge detection of the edge detection circuit 131 indicates that the current pixel Wc belongs to the image edge, the adjacent pixel adjustment circuit 132 can further compare the gray level of the target adjacent pixel Wn with the threshold gray level Nbrlevel_Th. When the result of the edge detection of the edge detection circuit 131 indicates that the current pixel Wc belongs to the image edge and the gray level of the target adjacent pixel Wn is less than the threshold gray level Nbrlevel_Th, the adjacent pixel adjustment circuit 132 can appropriately increase the gray level of the target adjacent pixel Wn. For example, when the current pixel Wc belongs to a bright image edge and the gray level of the adjacent pixel Wn is black, the adjacent pixel adjustment circuit 132 can appropriately brighten the gray levels of the adjacent pixels (e.g., the adjacent pixels Wn) at the image edge. In this way, the edge processing circuit 130 can solve the dual cell local dimming side view object invisible issue to improve the clarity of cell local dimming side view object.

Referring to FIG. 1 and FIG. 3, the source driver 120 is coupled to the calculation circuit 110 to receive the first image frame data F1. The source driver 140 is coupled to the edge processing circuit 130 to receive the third image frame data F3. In step S330, the source driver 120 can drive the first pixel array layer 11 of the display panel 10 according to the first image frame data F1 to display image frames. The source driver 140 can drive the second pixel array layer 12 of the display panel 10 according to the third image frame data F3 in step S330 to perform dimming (e.g., the local dimming or the global dimming).

According to different design requirements, the blocks of the calculation circuit 110, the gray pixel data calculation circuit 111, the gray pixel data calculation circuit 112, the color pixel data calculation circuit 113, the edge processing circuit 130, the edge detection circuit 131 and (or) the adjacent pixel adjustment circuit 132 may be implemented in hardware, firmware, software (program), or a combination of more of the three.

In terms of hardware, the blocks of the calculation circuit 110, the gray pixel data calculation circuit 111, the gray pixel data calculation circuit 112, the color pixel data calculation circuit 113, the edge processing circuit 130, the edge detection circuit 131 and (or) the adjacent pixel adjustment circuit 132 may be implemented in logic circuits on an integrated circuit. The related functions of the calculation circuit 110, the gray pixel data calculation circuit 111, the gray pixel data calculation circuit 112, the color pixel data calculation circuit 113, the edge processing circuit 130, the edge detection circuit 131 and (or) the adjacent pixel adjustment circuit 132 may be implemented as hardware using hardware description languages (e.g., Verilog HDL or VHDL) or other suitable programming languages. For instance, the related functions of the calculation circuit 110, the gray pixel data calculation circuit 111, the gray pixel data calculation circuit 112, the color pixel data calculation circuit 113, the edge processing circuit 130, the edge detection circuit 131 and (or) the adjacent pixel adjustment circuit 132 may be implemented as various logic blocks, modules and circuits in one or more controllers, microcontrollers, microprocessors, application-specific integrated circuits (ASIC), digital signal processors (DSP), field programmable gate arrays (FPGA) and/or other processing units.

In terms of software/firmware, the related functions of the calculation circuit 110, the gray pixel data calculation circuit 111, the gray pixel data calculation circuit 112, the color pixel data calculation circuit 113, the edge processing circuit 130, the edge detection circuit 131 and (or) the adjacent pixel adjustment circuit 132 may be implemented as programming codes. For example, the calculation circuit 110, the gray pixel data calculation circuit 111, the gray pixel data calculation circuit 112, the color pixel data calculation circuit 113, the edge processing circuit 130, the edge detection circuit 131 and (or) the adjacent pixel adjustment circuit 132 may be implemented using common programming languages (e.g., C or C++) or other suitable programming languages. The programming codes may be recorded/stored in a recording medium. A computer, a central processing unit (CPU), a controller, a microcontroller or a microprocessor can read and execute the programming codes from the recording medium to achieve the related functions of the calculation circuit 110, the gray pixel data calculation circuit 111, the gray pixel data calculation circuit 112, the color pixel data calculation circuit 113, the edge processing circuit 130, the edge detection circuit 131 and (or) the adjacent pixel adjustment circuit 132.

In summary, the driving circuit 100 and the operation method thereof described in the foregoing embodiments can drive a plurality of pixel array layers of the display panel 10, such as the first pixel array layer 11 and the second pixel array layer 12. The second pixel array layer 12 can realize the local dimming function and (or) the global dimming function. In some application scenarios, the display panel 10 may have the dual cell local dimming side view object invisible issue. The driving circuit 100 can perform the edge detection on the current pixel to determine whether the current pixel belongs to the image edge. According to the result of the edge detection, the driving circuit 100 can determine whether to adjust the gray level of the at least one adjacent pixel of the current pixel. For example, when the current pixel belongs to a bright image edge and the gray level of one adjacent pixel is black, the driving circuit 100 can appropriately brighten the gray levels of that adjacent pixel. In this way, the driving circuit 100 can solve the dual cell local dimming side view object invisible issue to improve the clarity of cell local dimming side view object.

Although the invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. A driving circuit, suitable for driving a display panel, the driving circuit comprising:

a calculation circuit, configured to convert original image frame data into first image frame data and second image frame data, wherein the first image frame data is suitable for driving a first pixel array layer of the display panel, the second image frame data is suitable for driving a second pixel array layer of the display panel, and the first pixel array layer is stacked on the second pixel array layer; and an edge processing circuit, coupled to the calculation circuit to receive the second image frame data, and configured to convert the second image frame data into third image frame data, wherein the third image frame data is suitable for driving the second pixel array layer, the edge processing circuit performs an edge detection on a current pixel in the second image frame data to determine whether the current pixel belongs to an image edge, and the edge processing circuit determines whether to adjust a gray level of at least one adjacent pixel in the second image frame data as the gray level of the at least one adjacent pixel in the third image frame data according to a result of the edge detection, wherein the edge processing circuit determines whether the current pixel belongs to the image edge by comparing a representative difference with a threshold, and wherein the at least one adjacent pixel comprises a target adjacent pixel, and wherein the edge processing circuit compares a gray level of the target adjacent pixel with a threshold gray level.

2. The driving circuit of claim 1, wherein the first pixel array layer comprises a color pixel array, the second pixel array layer comprises a gray pixel array, and the at least one adjacent pixel is adjacent to the current pixel.

3. The driving circuit of claim 1, wherein the calculation circuit comprises:

a gray pixel data calculation circuit, configured to calculate a gray level of the current pixel in the second image frame data according to at least one pixel data of at least one corresponding pixel in the original image frame data, wherein the gray pixel data calculation circuit outputs the original image frame data as the first image frame data, and the gray pixel data calculation circuit outputs the second image frame data to the edge processing circuit.

4. The driving circuit of claim 1, wherein the calculation circuit comprises:

a gray pixel data calculation circuit, configured to calculate a gray level of the current pixel in the second image frame data according to at least one pixel data of at least one corresponding pixel in the original image frame data, wherein the gray pixel data calculation circuit outputs the second image frame data to the edge processing circuit; and a color pixel data calculation circuit, coupled to the gray pixel data calculation circuit to receive the original image frame data and the second image frame data, and configured to generate the first image frame data by compensating the at least one pixel data of the at least one corresponding pixel in the original image frame data according to the gray level of the current pixel in the second image frame data.

5. The driving circuit of claim 1, wherein the edge processing circuit comprises:

an edge detection circuit, coupled to the calculation circuit to receive the second image frame data, and configured to determine whether the current pixel belongs to the image edge by checking a relation between a gray level of the current pixel and the gray level of the at least one adjacent pixel in the second image frame data and output the result of the edge detection; and an adjacent pixel adjustment circuit, coupled to the edge detection circuit to receive the result of the edge detection, and configured to determine whether to adjust the gray level of the at least one adjacent pixel in the second image frame data as the gray level of the at least one adjacent pixel in the third image frame data according to the result of the edge detection.

6. The driving circuit of claim 5, wherein the at least one adjacent comprises a plurality of adjacent pixels, the edge detection circuit obtains a plurality of gray level differences by calculating a difference between the gray level of the current pixel and a gray level of each of the adjacent pixels, and the edge detection circuit determines whether the current pixel belongs to the image edge by checking the gray level differences.

7. The driving circuit of claim 6, wherein the edge detection circuit takes a largest difference of the gray level differences as the representative difference.

8. The driving circuit of claim 5, wherein when the result of the edge detection indicates that the current pixel does not belong to the image edge, the adjacent pixel adjustment circuit uses the gray level of the at least one adjacent pixel in the second image frame data as the gray level of the at least one adjacent pixel in the third image frame data; and when the result of the edge detection indicates that the current pixel belongs to the image edge, the adjacent pixel adjustment circuit determines whether to adjust the gray level of the at least one adjacent pixel in the second image frame data as the gray level of the at least one adjacent pixel in the third image frame data by checking the gray level of the at least one adjacent pixel.

9. The driving circuit of claim 8, wherein when the result of the edge detection indicates that the current pixel belongs to the image edge and the gray level of the target adjacent pixel is less than the threshold gray level, the adjacent pixel adjustment circuit adjusts the gray level of the target adjacent pixel to a register define gray level.

10. The driving circuit of claim 1, wherein the resolution of the second image frame data is smaller than the resolution of the original image frame data.

11. An operation method of a driving circuit, comprising:

converting original image frame data into first image frame data and second image frame data by a calculation circuit, wherein the first image frame data is suitable for driving a first pixel array layer of a display panel, the second image frame data is suitable for driving a second pixel array layer of the display panel, and the first pixel array layer is stacked on the second pixel array layer;

converting the second image frame data into third image frame data by an edge processing circuit, wherein the third image frame data is suitable for driving the second pixel array layer, and the edge processing circuit performs an edge detection on a current pixel in the second image frame data to determine whether the current pixel belongs to an image edge and the edge processing circuit determines whether to adjust a gray level of at least one adjacent pixel in the second image frame data as the gray level of the at least one adjacent pixel in the third image frame data according to a result of the edge detection, wherein the at least one adjacent pixel comprises a target adjacent pixel;

comparing a gray level of the target adjacent pixel with a threshold gray level by the edge processing circuit; and determining whether the current pixel belongs to the image edge by comparing a representative difference with a threshold by the edge processing circuit.

12. The operation method of claim 11, wherein the first pixel array layer comprises a color pixel array, the second pixel array layer comprises a gray pixel array, and the at least one adjacent pixel is adjacent to the current pixel.

13. The operation method of claim 11, further comprising:

calculating a gray level of the current pixel in the second image frame data according to at least one pixel data of at least one corresponding pixel in the original image frame data; and outputting the original image frame data as the first image frame data.

14. The operation method of claim 11, further comprising:

calculating a gray level of the current pixel in the second image frame data according to at least one pixel data of at least one corresponding pixel in the original image frame data by a gray pixel data calculation circuit of the calculation circuit; and generating the first image frame data by compensating the at least one pixel data of the at least one corresponding pixel in the original image frame data according to the gray level of the current pixel in the second image frame data by a color pixel data calculation circuit of the calculation circuit.

15. The operation method of claim 11, further comprising:

determining whether the current pixel belongs to the image edge by checking a relation between a gray level of the current pixel and the gray level of the at least one adjacent pixel in the second image frame data by an edge detection circuit of the edge processing circuit; and determining whether to adjust the gray level of the at least one adjacent pixel in the second image frame data as the gray level of the at least one adjacent pixel in the third image frame data according to the result of the edge detection by an adjacent pixel adjustment circuit of the edge processing circuit.

16. The operation method of claim 15, wherein the at least one adjacent comprises a plurality of adjacent pixels, and the operation method further comprises:

obtaining a plurality of gray level differences by calculating a difference between the gray level of the current pixel and a gray level of each of the adjacent pixels by the edge detection circuit; and determining whether the current pixel belongs to the image edge by checking the gray level differences by the edge detection circuit.

17. The operation method of claim 16, further comprising:

taking a largest difference of the gray level differences as a representative difference by the edge detection circuit.

18. The operation method of claim 15, further comprising:

using the gray level of the at least one adjacent pixel in the second image frame data as the gray level of the at least one adjacent pixel in the third image frame data by the adjacent pixel adjustment circuit when the result of the edge detection indicates that the current pixel does not belong to the image edge; and determining whether to adjust the gray level of the at least one adjacent pixel in the second image frame data as the gray level of the at least one adjacent pixel in the third image frame data by checking the gray level of the at least one adjacent pixel by the adjacent pixel adjustment circuit when the result of the edge detection indicates that the current pixel belongs to the image edge.

19. The operation method of claim 18, wherein the operation method further comprises:

comparing the gray level of the target adjacent pixel with the threshold gray level by the adjacent pixel adjustment circuit; and adjusting the gray level of the target adjacent pixel to a register define gray level by the adjacent pixel adjustment circuit when the result of the edge detection indicates that the current pixel belongs to the image edge and the gray level of the target adjacent pixel is less than the threshold gray level.

20. The operation method of claim 11, wherein the resolution of the second image frame data is smaller than the resolution of the original image frame data.

* * * * *